United States Patent [19]

Turner, Jr.

[11] Patent Number: 4,625,706

[45] Date of Patent: Dec. 2, 1986

[54] ELASTIC POWERED COMPRESSED AIR GUN

[76] Inventor: John E. Turner, Jr., 11900 Montana Ave., El Paso, Tex. 79936

[21] Appl. No.: 767,093

[22] Filed: Aug. 19, 1985

[51] Int. Cl.[4] ..... F41B 7/08; F41B 11/00

[52] U.S. Cl. ..... 124/67; 124/22; 42/100

[58] Field of Search ..... 124/17, 20 R, 21, 22, 124/65, 66, 67, 68, 80; 42/1 S, 1 ST, 16; 446/473; 33/247, 248

[56] References Cited

U.S. PATENT DOCUMENTS

| | | | |
|---|---|---|---|
| D. 159,040 | 6/1950 | Bicos | D22/3 |
| 172,583 | 1/1876 | Pope | 124/67 |
| 179,984 | 7/1876 | Walker | 124/67 |
| 182,899 | 10/1876 | Cross | 124/67 |
| D. 201,366 | 6/1965 | Chambers et al. | D22/6 |
| 302,283 | 7/1884 | Quackenbush | 124/67 |
| 782,716 | 2/1905 | Bennett | 42/16 |
| 1,310,745 | 7/1919 | Falk | 124/67 |
| 1,974,016 | 9/1934 | Doe | 33/248 |
| 2,069,821 | 2/1937 | Douglas | 124/67 |
| 2,087,996 | 7/1937 | Rarey | 33/248 |
| 2,214,224 | 9/1940 | Douglas | 124/67 |
| 2,526,305 | 10/1950 | Van Blarcom | 124/67 |
| 2,580,356 | 12/1951 | Martin | 124/66 |
| 2,713,859 | 7/1955 | Bradfield | 124/45 |
| 3,142,293 | 7/1964 | Harter | 124/57 |
| 3,374,544 | 3/1968 | Pitchford | 33/247 |
| 3,552,372 | 1/1971 | Wilkerson | 124/67 |
| 3,983,860 | 10/1976 | Bolton | 124/80 X |
| 4,212,285 | 7/1980 | Cagen et al. | 124/67 |

FOREIGN PATENT DOCUMENTS

| | | | |
|---|---|---|---|
| 1194030 | 6/1970 | United Kingdom | 124/66 |

*Primary Examiner*—Richard T. Stouffer

*Attorney, Agent, or Firm*—Harvey B. Jacobson

[57] ABSTRACT

An elongated horizontal barrel, transfer tube and cylinder are provided in vertically laterally stacked relation with the barrel disposed uppermost and the cylinder disposed lowermost. Closure structure is provided for the rear end of the barrel and the rear end of the barrel and transfer tube are in closed communication with each other while the forward ends of the transfer tube and cylinder are in closed communication with each other. The closure structure is shiftable to a position opening the rear end of the barrel and the rear end of the barrel may receive a blow dart therein after which the rear end of the barrel is closed. A piston is freely slidable within the cylinder and elastic tubing structure is provided for yieldingly biasing the piston forwardly within the cylinder and cocking structure is provided whereby the piston may be manually displaced rearwardly in the cylinder against the biasing action of the force structure. Finally, trigger actuatable retaining structure is provided for releasably retaining the piston in a rearmost displaced position within the cylinder.

15 Claims, 8 Drawing Figures

78
12
82
88
86
16
80
46
44
48
14
38
42
110
106
114
84
4
118
108
112
116
101
90
99
100
98
94
92
96
5
30
28
36
35
32
34
26
50
58
54
56
52

80
20
108
118
114
99
104
98
92
64
66
62
60
100
30
28
48
34
32
22
26
50
42
72
74
76

ELASTIC POWERED COMPRESSED AIR GUN

BACKGROUND OF THE INVENTION

1. Field of the Invention

This invention relates to a dart gun including a barrel in which a dart may be received and through and from which the dart may be projected by compressed air supplied to the breech end of the barrel. The gun includes a cylinder having a piston slidable therein, retractable to a cocked position and yieldingly biased toward one end of the cylinder by elastic surgical tubing. The one end of the cylinder is communicated with the breech end of the barrel and the barrel breech end includes a closure therefor in the form of a retractable bolt to provide access to the barrel breech end for the insertion of a dart thereinto.

2. Description of Related Art

Various different forms of fluid pressure powered guns heretofore have been provided including some of the general structural and operational features of the instant invention. Examples of these previously known forms of guns are disclosed in U.S. Pat. Nos. 1,310,745, 2,069,821, 2,214,224, 2,713,859, 3,142,293, 3,552,372, 4,212,285 and Pat. Nos. Des. 159,040 and 201,366.

SUMMARY OF THE INVENTION

This invention relates to an air gun in the form of a rifle wherein a retractable piston is slidably mounted within a cylinder and is yieldingly biased toward one end of the cylinder through the utilization of tensioned surgical tubing sections. A barrel is provided having muzzle and breech ends and a transfer tube is disposed between and parallels the barrel and cylinder and communicates the forward end of the cylinder toward which the piston is yieldingly biased with the rear breech end of the barrel. An oscillatable and longitudinally shiftable breech bolt is provided for removably closing the breech end of the barrel and may be shifted to a rearwardly displaced open position to provide access to the breech end of the barrel for the purpose of enabling a dart to be inserted therein. The breech bolt includes a laterally projecting handle and cam structure for retaining the breech bolt in a forward displaced position closing the breech end of the barrel upon swinging movement of the handle to either side of the barrel from a center position thereof. The rear end of the cylinder includes a centrally apertured end wall through which a piston rod connected to the piston is slidably received and the rear end of the rod includes a handle thereon whereby the rod may be retracted rearwardly. The gun includes trigger structure for releasably retaining the piston rod in a rearwardly retracted position and the rod is yieldingly biased forwardly in the cylinder through the utilizaton of surgical tubing member sections having one set of corresponding ends anchored to a forward stock portion of the gun and a second set of corresponding end portions anchored relative to the handle on the rear of the piston rod.

The main object of this invention is to provide a readily operable gun which may be used to propel darts therefrom at high velocity.

Another object of this invention is to provide a dart gun in accordance with the preceding objects and which utilizes air under pressure as the motive force for propelling a dart through and from the barrel of the gun.

Still another important object of this invention is to provide a dart gun in accordance with the preceding objects and wherein the compressed air for operating the gun is produced by air compressed in one end of the cylinder as a piston slidable in the cylinder is forced from the other end of the cylinder toward the one end thereof.

A further object of this invention is to provide a dart gun including tensioned surgical tubing operatively connected between the stock of the gun and the air pressure producing piston for yieldingly biasing the piston toward the end of the cylinder in which air is compressed.

Still another object of this invention is to provide a dart gun including a simple tube-type sight.

A final object of this invention to be specifically enumerated herein is to provide a dart gun in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
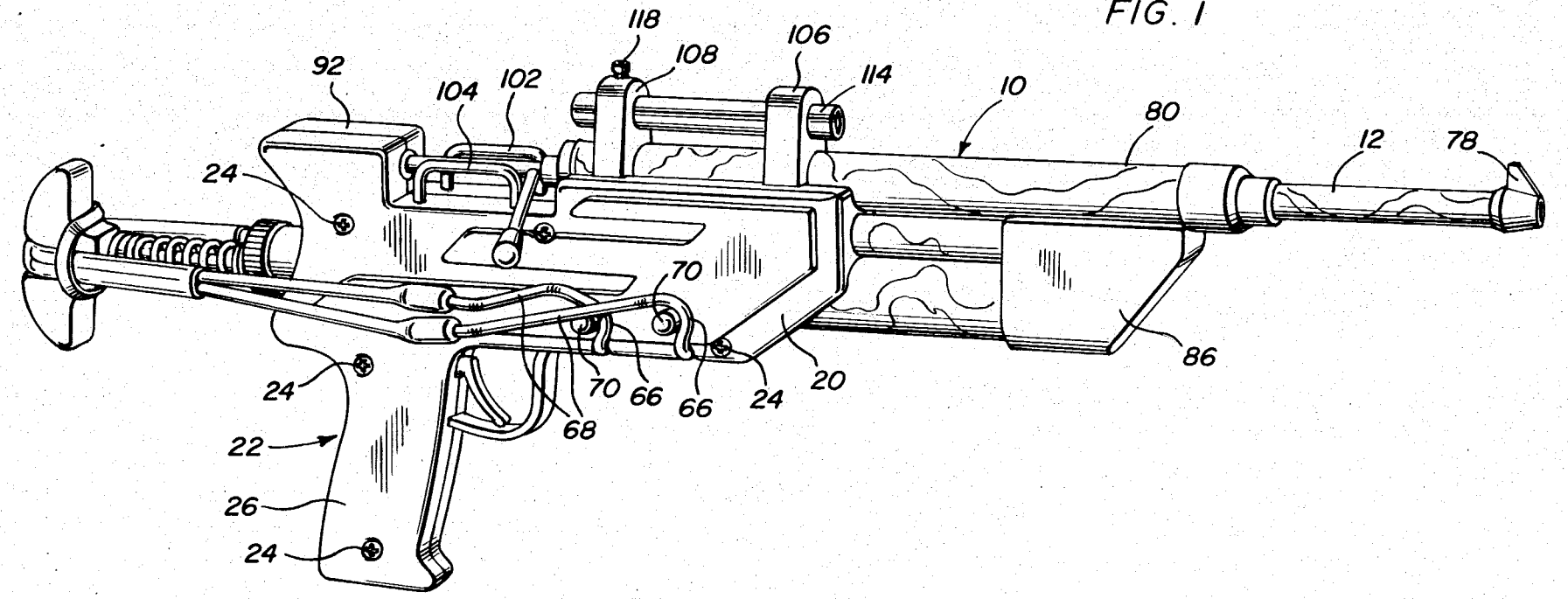
FIG. 1 is a perspective view of the dart gun.
Figure 2:
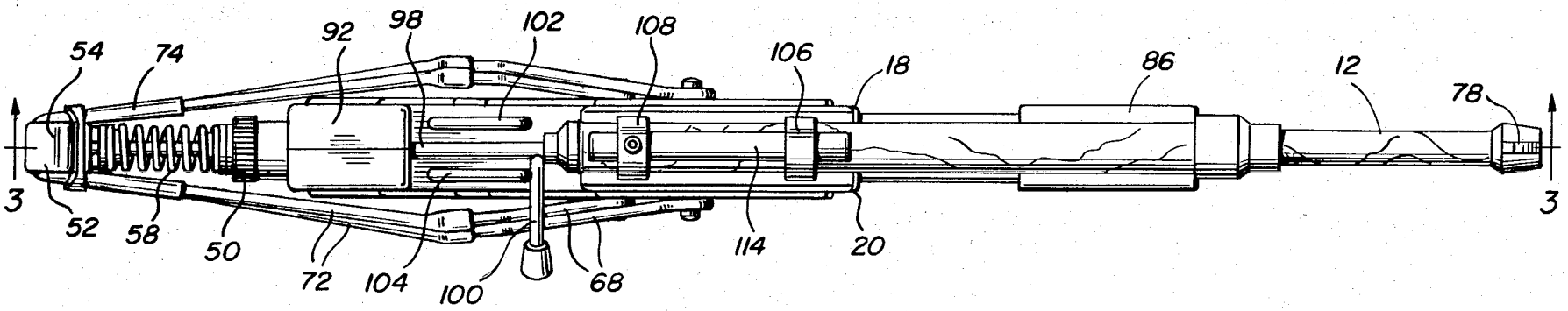
FIG. 2 is a top plan view of the dart gun.

Referring now more specifically to the drawings, the numeral 10 generally designates the dart gun of the instant invention. The dart gun 10 includes a barrel 12, a pneumatic cylinder assembly referred to in general by the reference numeral 14 and a transfer tube 16 clamped between opposite side portions 18 and 20 of a body or stock assembly referred to in general by the reference numeral 22, the opposite side portions 18 and 20 being secured together through the utilization of transverse fasteners 24.

Figure 4:
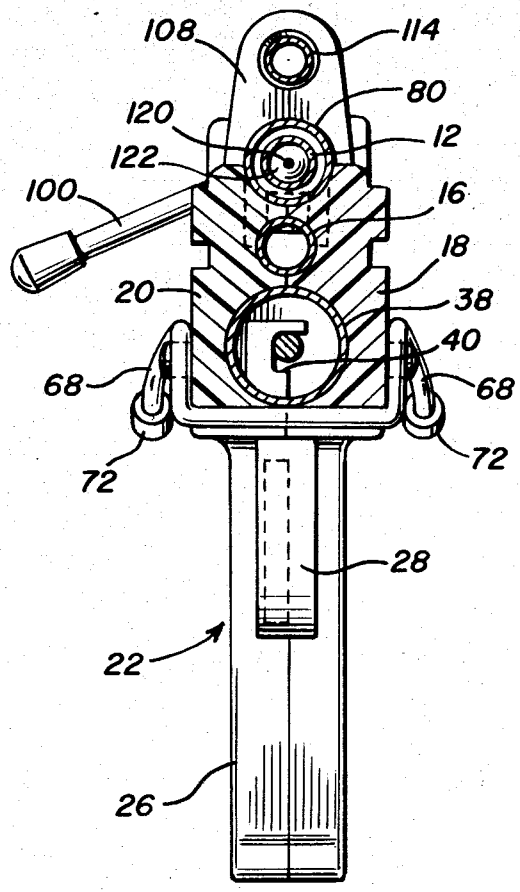
FIG. 4 is an enlarged transverse vertical sectional view taken substantially upon the plane indicated by the section line 4—4 of FIG. 3.

The barrel 12, cylinder assembly 14 and transfer tube 16 are held against shifting relative to each other between the opposite side portions 18 and 20 in parallel relation and with the barrel 12 uppermost and the cylinder assembly 14 lowermost. The stock assembly 22 includes a hand grip 26 which extends downwardly from the rear of the stock assembly 22 and a trigger guard 28 is clamped between the opposite side portions 18 and 20 and encloses a trigger 30 pivotally supported from the stock assembly 22 as at 32. The trigger assembly is received through a laterally opening notch formed in a vertically disposed and reciprocal piston rod retainer 34 reciprocally mounted between the opposite side portions 18 and 20 for movement in a substantially vertical plane and an expansion spring 35 is operatively connected between the lower end of the retainer 34 and a lower portion of the interior of the handgrip 26 and yieldingly biases the retainer 34 in a downward direction. The upper end of the retainer 34 extends upwardly through an opening 36 provided therefor in the rear portion of the cylinder 38 of the cylinder assembly 14 and includes a laterally opening notch 40, see FIG. 4, through which a piston rod 42 reciprocal in the cylinder 38 extends.

The forward end of the piston rod 42 has a piston 44 mounted thereon provided with a cupped annular seal 46 sealingly and slidingly disposed within the cylinder 38 and the forward end of the rod 42 includes an upwardly opening notch 48 formed therein with which the notched upper end portion of the retainer 34 is engageable to retain the piston 42 in a rearwardly displaced "cocked" position.

The rear end of the piston rod 42 extends through a centrally apertured rear wall 50 secured over the rear end of the cylinder 38 and the rear extremity of the rod 42 includes a handle 52 supported therefrom including finger engageable portions 54 projecting oppositely outwardly fron the rod 42. In addition, the rear of the handle 52 includes a rearwardly opening transverse notch 56 formed therein and a coiled compression spring 58 is disposed about the rod 42 intermediate the handle 52 and the rear wall 50 to cushion the handle 52 against sudden impact with the rear wall 50 as the rod 42 is rapidly displaced forwardly.

The underside of the body 22 includes a pair of longitudinally spaced downwardly opening transverse notches 60 formed therein and the bight portions 62 of a pair of generally U-shaped anchors 64 are seated within the notches 60 and have the curved portions 66 of their oppositely laterally outwardly and rearwardly inclined arms 68 passed about pairs of opposite side laterally outwardly projecting abutment pins 70 carried by the opposite side portions 18 and 20.

A pair of elastic surgical tubing members 72 are provided and one pair of corresponding ends of the tubing members 72 are telescoped over and thus anchored to the free ends of one pair of corresponding arms 68 and the other pair of corresponding ends of the tubing members 72 are telescoped over and thus anchored relative to the free ends of the other pairs of arms 68. The tubing members 72 are thus arranged in a U-shaped pattern and the bight portions of the tubing members 72 are received through a protective sleeve 74 seated in the rearwardly opening notch 56, an elastic band 76 being disposed about the opposite ends of the tubing sleeve 74 immediately forward of the portions 54 of the handle 52. The plastic sleeve serves as a safety member preventing totally free rearward snapping of one of the tubing members 72 in the event one front end thereof slips from its anchor arm 68 and the elastic band 76 serves to maintain the bight portions of the tubular members 72 and the protective sleeve 74 seated in the notch 56 and also to prevent free rearward snapping of one end of the sleeve and the attendant tubing member ends in the event both tubing member ends should break.

Figure 3:
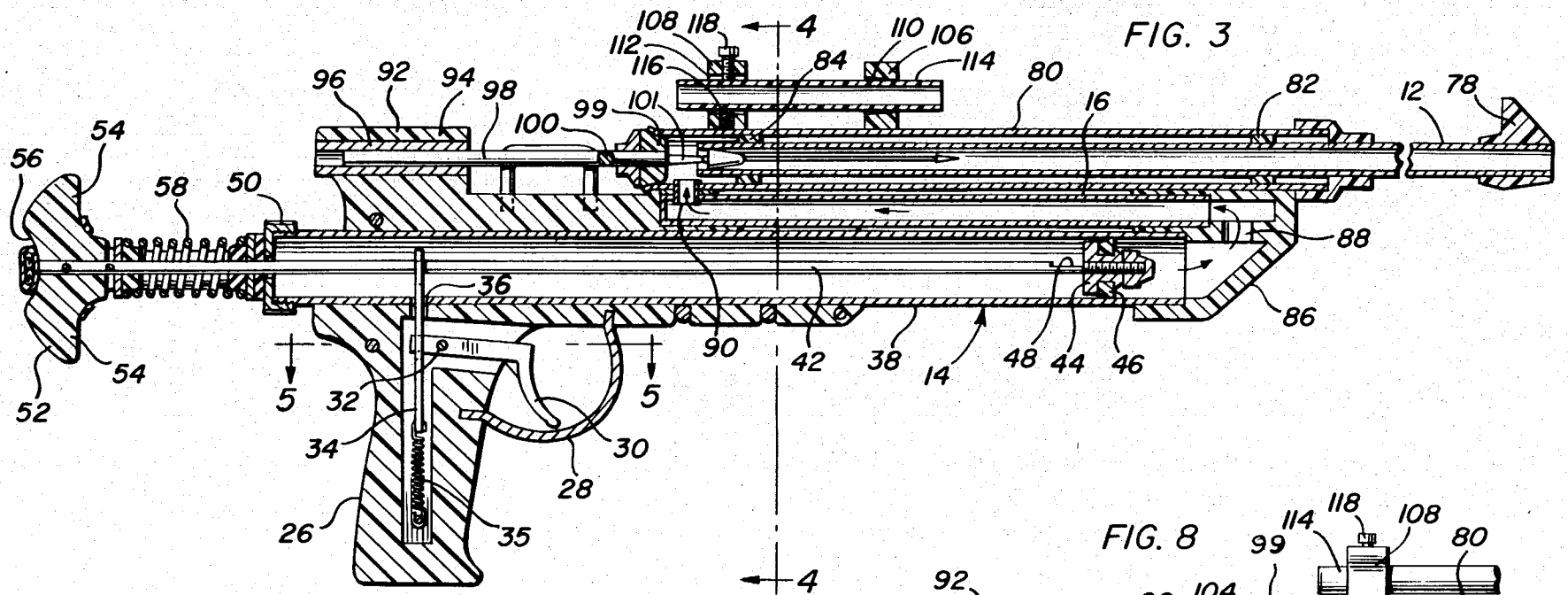
FIG. 3 is a fragmentary longitudinal vertical sectional view taken substantially upon the plane indicated by the section line 3—3 of FIG. 2.

The forward end portion of the barrel 12 includes an upstanding forward sight 78 and the rear end portion of the barrel 12 is enclosed within an outer tube or sleeve 80 sealed relative to the barrel 12 at its forward end as at 82 and sealed relative to the rear end of the barrel 12 as at 84, see FIG. 3. Further, a forward cap 86 sealingly receives the forward ends of the cylinder 38 and transfer tube 16 therein and includes a passage 88 therein by which communication is established between the front end of the cylinder 38 and the front end of the transfer tube 16. An upstanding tubular fitting 90 establishes communication between the rear end of the transfer tube 16 and the interior of the rear end of the tube 80 rearward of the seal defined between the rear ends of the tube 80 and the barrel 12 as at 84. Accordingly, rapid movement of the piston 44 forwardly in the cylinder 38 will cause compressed air to pass from the forward end of the cylinder 38, through the passage 88, rearwardly through the transfer tube 16 and upwardly through the fitting 90 into the rear end of the barrel 12.

The upper rear portion of the stock assembly 22 includes a boss 92 through which a front-to-rear extending bore 94 is formed and the bore 94 has a bearing sleeve 96 mounted therein which slidably and oscillatably receives the rear end of a cylindrical breech bolt 98 therein. The breech bolt 98 includes a laterally outwardly projecting handle 100 and the opposite side portions 18 and 20 include inverted U-shaped cam bars 102 and 104, respectively, supported therefrom forward of the boss 92. Further, the forward end of the bolt 98 includes a resilient seal plug 99 mounted thereon seatingly and sealingly engageable with the otherwise open rear end of the tube 80 disposed rearward of the fitting 90 and the bolt 98 projects forward of the plug 102 and terminates in a forwardly tapering forward extremity 101 for a purpose to be hereinafter more fully set forth.

A pair of upstanding front and rear sight mounts 106 and 108 are clampingly supported from opposing notched portions of the opposite side portions 18 and 20 and the sight mount 106 has a horizontal forwardly tapering bore 110 formed therethrough paralleling the barrel 12. The sight mount 108 includes a larger diameter bore 112 formed therethrough and the front and rear ends of a tubular sight 114 are received through the bores 110 and 112. Further, the mount 108 includes a compression spring 116 yieldingly biasing the rear end of the tube 114 upwardly and a set screw 118 threadingly supported therefrom by which the rear end of the sight tube 114 may be downwardly adjusted.

Figure 8:
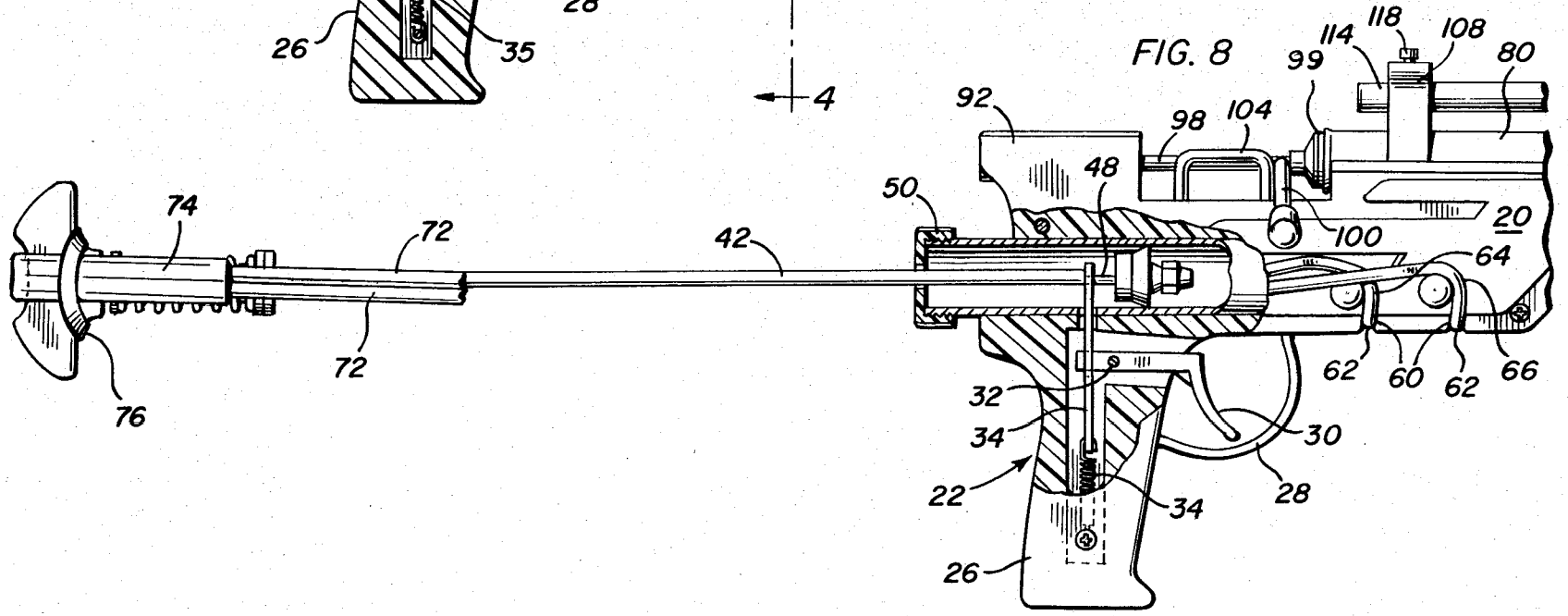
FIG. 8 is a fragmentary side elevational view of the rear of the gun with portions thereof being broken away and illustrated in vertical section and the piston rod portion of the gun cocked in a retracted position preparatory to firing the gun.
Figure 6:
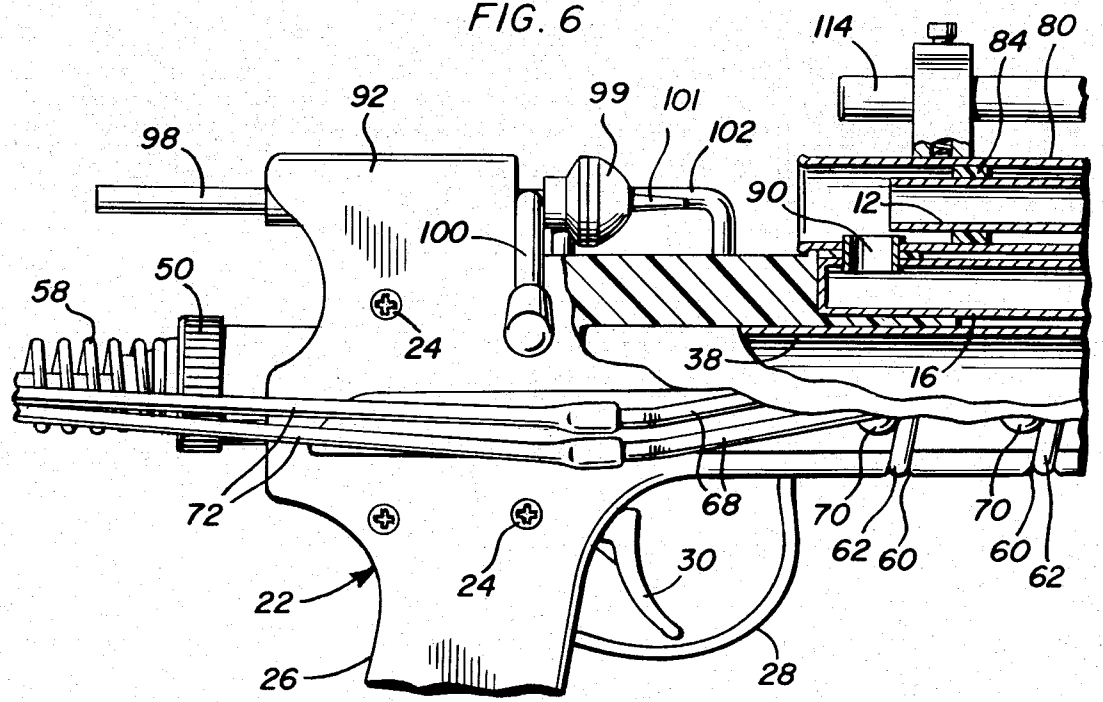
FIG. 6 is a fragmentary enlarged side elevational view of the breech end of the dart gun with portions of the gun being broken away and illustrated in vertical section and the breech end closing bolt of the gun in a rearwad retracted position.
Figure 7:
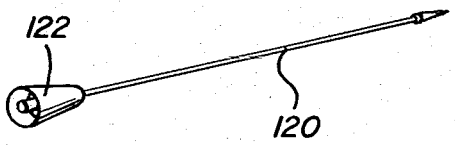
FIG. 7 is a perspective view of one form of dart which may be used with gun of the instant invention.
Figure 5:
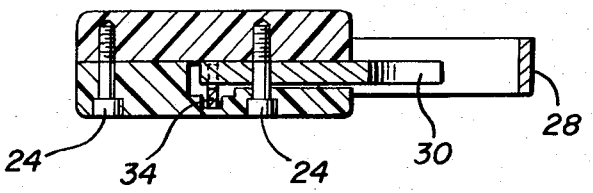
FIG. 5 is a horizontal sectional view taken substantially upon the plane indicated by the section line 5—5 of FIG. 3.

In operation, the handle 52 is grasped and pulled rearwardly in order to rearwardly retract the piston 44 to the "cocked" position thereof illustrated in FIG. 8 of the drawings with the upper notched end of the retainer 34 engaged in the notch 48 at the forward end of the rod 42 immediately rearward of the piston 44. Thereafter, or prior to having "cocked" the piston 44, the bolt 98 is rotated by handle 100 to a position with the handle 100 projecting upwardly and the bolt 98 is rearwardly displaced to the position thereof illustrated in FIG. 6 with the handle 100 disposed rearwardly of one of the cam brackets 102 and 104. Thereafter, a dart such as dart 120 is inserted into the rear end of the tube 80 and the rear end of the barrel 12 with the rearwardly opening cup-shaped tail 122 of the dart 120 positioned in the rear extremity of the barrel 12. Then, the handle 100 may be raised to the intermediate position thereof and forwardly displaced toward the forward ends of the cam bracket 102 and 104 and thereafter swung downwardly to a position in front of either bracket 102 or bracket 104. This will cam the plug 99 into tight sealed engagement with the rear end of the tube 80 and will allow the forward extremity 101 of the bolt 98 to slightly forwardly displace the dart 120 within the barrel 12 to the position thereof illustrated in FIG. 3. Then, upon exerting a rearward pull on the trigger 30, the retainer 34 will be upwardly displaced against the biasing action of the expansion spring 34 in order to release the rod 42 whereby the tensioned tubing members 72 will rapidly forwardly displace the rod 42 and thus the piston 44 in the cylinder 38. This will cause air to be compressed within the forward end of the cylinder assembly 14, to pass through the passage 88 and then rearwardly through the transfer tube 16 and upwardly through the fitting 90 into the rear of the tube 80 and the rear of the barrel 12 for propelling the dart 120 rapidly forwardly through and from the barrel 12.

Inasmuch as the handle 100 may be pivoted to either side of the stock assembly 26, the gun 10 may be conveniently used by either a right-handed person or a left-handed person.

Further, it is deemed apparent that more than two tubing members 72 could be utilized to drive the piston 44 forwardly in the cylinder 38 and that the power of the gun 10 thus may be increased, if desired. On the other hand, one of the tubing members 72 may be removed in order to reduce the power of the gun 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An air gun including a tubular barrel having muzzle and breech ends, said gun including an elongated cylinder and a piston slidable in said cylinder, resilient means connected between said cylinder and piston operative to yieldably bias said piston toward one end of said cylinder, latch means operative to releasably retain said piston in a "cocked" position displaced toward the other end of said cylinder from said one end, cocking means operative from the exterior of said cylinder for manually displacing said piston from said one end of said cylinder toward said "cocked" position, closing means removably closing said breech end of said barrel, said breech end of said barrel, when open, being operative to receive a projectile therein with said projectile enjoying a free sliding fit in said barrel for projection from said muzzle end responsive to fluid pressure admitted into said breech end behind said projectile when said breech end is closed, and communicating means communicating said one end of said cylinder with said breech end of said barrel forward of said breech end closing means, said resilient means including elongated elastic means including a pair of generally parallel arms and a bight portion extending between and connecting one pair of ends of said arms, the other pair of ends of said arms being anchored relative to said barrel forward of said breech end, said bight portion being anchored relative to said cocking means, an elongated stock from which said barrel and cylinder are supported, an intermediate length portion of said stock including a transverse notched underside and oppositely outwardly projecting opposite side abutment pins, anchor means in the form of a generally U-shaped anchor incorporating a pair of arms interconnected at one pair of ends by a connecting bight portion extending therebetween, said bight portion of said anchor means being removably seated in said notched underside and said arms of said anchor means extending rearwardly from said bight portion of said anchor means along opposite sides of said stock, the forward ends of said anchor means arms adjacent said anchor means bight portion including curved portions extending over and curving downwardly in front of said pins toward and joined to said anchor means bight portion, the curved portions of said anchor means arms being abutingly engaged with said pins, the other pair of ends of said elastic means arms being anchored to the rear ends of said anchor means arms.

2. The gun of claim 1 wherein said cylinder generally parallels said barrel in laterally spaced relation therewith and said piston includes a piston rod projecting outwardly of said other end of said cylinder and comprises said cocking means, said other end of said cylinder projecting rearwardly from the rear end of said stock.

3. The gun of claim 2 wherein said communicating means includes a pressure transfer tube supported from said stock generally paralleling said barrel and having a first end communicated with said one cylinder end and a second end communicated with said breech end forward of said closing means.

4. The gun of claim 3 wherein said transfer tube is spaced between said barrel and said cylinder.

5. The gun of claim 4 wherein said barrel is disposed uppermost and said cylinder is disposed lowermost.

6. The gun of claim 3 wherein said stock includes a pair of opposite side stock portions between which said barrel, cylinder and transfer tube are clampingly engaged and held against relative displacement.

7. The gun of claim 6 wherein said end of said rod remote from said piston includes handle means thereon disposed outwardly of said other end of said cylinder when said piston is disposed in said one end of said cylinder.

8. The gun of claim 6 wherein said stock includes a pair of front and rear upwardly projecting sight mounts supported therefrom at points spaced along said barrel, one of said sight mounts including a horizontal tapered bore formed therethrough generally paralleling said bore and the other of said mounts having a vertically elongated opening formed therethrough registered with said tapered bore, an elongated sight tube having its opposite ends received through said opening and said tapered bore, means yieldingly biasing the portion of said sight tube received through said opening toward an upper position in said opening, and abutment screw means carried by said mount having said opening formed therethrough adjustably downwardly displacing the corresponding end of said sight tube in said opening.

9. The gun of claim 2 wherein said end of said rod remote from said piston includes handle means thereon disposed outwardly of said other end of said cylinder when said piston is disposed in said one end of said cylinder.

10. The gun of claim 9 wherein said handle means includes a pair of opposite side portions projecting laterally outwardly from opposite sides of said rod and a rearwardly opening notch extending transversely of the direction in which the opposite side portions project, said bight portion of said arms being seated in said notch.

11. The gun of claim 9 wherein said other end of said cylinder includes a centrally apertured end wall thereon through which said rod is slidingly received, and compression spring means disposed about said rod intermediate said handle means and said end wall.

12. The gun of claim 1 wherein said closing means includes an elongated bolt longitudinally displaceable toward and away from said breech end of said barrel.

13. The gun of claim 12 wherein said bolt is mounted for oscillation about its longitudinal axis and said bolt and gun include means operative to lock said bolt in position closing said breech end of said barrel upon angular displacement of said bolt in either direction from a center position thereof.

14. An air gun including a tubular barrel having muzzle and breech ends, said gun including an elongated cylinder and a piston slidable in said cylinder, resilient means connected between said cylinder and piston operative to yieldably bias said piston toward one end of said cylinder, latch means operative to releasably retain said piston in a "cocked" position displaced toward the other end of said cylinder from said one end, cocking means operative from the exterior of said cylinder toward said "cocked" position, closing means removably closing said breech end of said barrel, said breech end of said barrel, when open, being operative to receive a projectile therein with said projectile enjoying a free sliding fit in said barrel for projection from said muzzle end responsive to fluid pressure admitted into said breech end behind said projectile when said breech end is closed, communicating means communicating said one end of said cylinder with said breech end of said barrel forward of said breech end closing means, said end of said rod remote from said piston including handle means thereon disposed outwardly of said other end of said cylinder when said piston is disposed in said one end of said cylinder, said resilient means including elongated elastic means including a pair of generally parallel arms and a bight portion extending between and connecting one pair of ends of said arms, the other pair of ends of said arms being anchored relative to said barrel forward of said breech end, said bight portion being anchored relative to said handle means, said handle means including a pair of opposite side portions projecting laterally outwardly from opposite sides of said rod and a rearwardly opening notch extending transversely of the direction in which the opposite side portions project, said bight portion being seated in said notch, a tensioned elastic band disposed forward of said opposite side portions and passing about said rod and the portions of said end portions of said arms adjacent said bight portion to provide the anchoring of said bight portion to said handle means.

15. The gun of claim 14 including a flexible protective and safety sleeve telescoped over said bight portion and the adjacent ends of said arms, said protective sleeve being seated in said notch and said tensioned elastic band being passed about the opposite ends of said sleeve, said sleeve serving to prevent free rearward snapping of one of said other ends of said arms in the event that said one of said ends becomes unanchored.

* * * * *